US007764916B2

(12) United States Patent
Kagawa

(10) Patent No.: US 7,764,916 B2
(45) Date of Patent: Jul. 27, 2010

(54) FIXING DEVICE AND IMAGE FORMING APPARATUS

(75) Inventor: Tetsuya Kagawa, Aichi-ken (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 249 days.

(21) Appl. No.: 11/872,882

(22) Filed: Oct. 16, 2007

(65) Prior Publication Data

US 2008/0124151 A1 May 29, 2008

(30) Foreign Application Priority Data

Oct. 20, 2006 (JP) ..... 2006-286086

(51) Int. Cl.
*G03G 15/20* (2006.01)
*H05B 6/14* (2006.01)

(52) U.S. Cl. ..... 399/334; 399/330; 219/619

(58) Field of Classification Search ..... 399/33, 399/328, 329, 330, 334; 219/619
See application file for complete search history.

(56) References Cited

U.S. PATENT DOCUMENTS

| | | | | |
|---|---|---|---|---|
| 6,246,843 | B1 * | 6/2001 | Nanataki et al. | 399/334 X |
| 6,373,036 | B2 * | 4/2002 | Suzuki | 219/619 |
| 6,453,144 | B1 * | 9/2002 | Sato | 399/328 |
| 6,687,481 | B2 * | 2/2004 | Watanabe et al. | 399/328 |
| 7,005,619 | B2 | 2/2006 | Fujii et al. | |
| 7,009,158 | B2 * | 3/2006 | Sekiguchi et al. | 219/619 |
| 7,122,769 | B2 * | 10/2006 | Nami et al. | 219/619 |
| 7,238,924 | B2 * | 7/2007 | Kondo et al. | 219/619 |
| 2006/0029411 | A1 * | 2/2006 | Ishii et al. | 219/619 X |

FOREIGN PATENT DOCUMENTS

| | | |
|---|---|---|
| JP | 8-016006 | 1/1996 |
| JP | 2005-108603 | 4/2005 |
| JP | 2005-321642 | 11/2005 |
| JP | 2006-78634 A | 3/2006 |

OTHER PUBLICATIONS

Japanese Office Action, mailed Aug. 12, 2008, directed to counterpart Japanese Patent Application No. 2006-286086; 7 pages.

* cited by examiner

*Primary Examiner*—Sandra L Brase
(74) *Attorney, Agent, or Firm*—Morrison & Foerster LLP

(57) ABSTRACT

In an image forming apparatus having a fixing rotor (22) that is driven to rotate and fixes an image by heating a recording paper while conveying the paper pressurized against the rotor, an excitation coil (24) that is provided extending in an axial direction along the fixing rotor (22) and causes induction heating by applying an alternating magnetic field to the fixing rotor (22), and a demagnetizing coil (25) that is provided superposed on an end of the excitation coil (24) and is able to partially diminish a magnetic flux generated by the excitation coil (24), by making the shape of the portion that belongs to the demagnetizing coil (25) and overlaps the excitation coil (24) has an asymmetrical shape have no axis of symmetry in the direction in which the recording paper is conveyed, a trouble due to overheating and defective fixing due to a shortage in the generation of heat can be reduced even when a plurality of kinds of recording papers of slightly different sizes are used.

16 Claims, 6 Drawing Sheets

FIXING DEVICE AND IMAGE FORMING APPARATUS

RELATED APPLICATION

The present invention is based on Patent Application No. 2006-286086 filed in Japan.

BACKGROUND OF THE INVENTION

The present invention relates to a fixing device and an image forming apparatus.

In an electrophotographic system image forming apparatus, a fixing device that fixes a toner by heating a recording paper while pressurizing the paper against a fixing roller (fixing rotor) is employed. In a conventional fixing device, the fixing roller is heated throughout the entire length thereof. When fixing a recording paper of a narrow width, the recording paper is not brought in contact with ends of the fixing roller, and heat is not consumed. Therefore, it has sometimes been the case where the temperature of the ends of the fixing roller has abnormally risen when recording papers of a narrow width have been continuously fixed.

Particularly, in a fixing unit that causes induction heating by applying an alternating magnetic field to the fixing roller by means of an excitation coil, it is general to shorten the warmup time by reducing the thermal capacity of the fixing roller for a reduction in energy consumption. The recording papers to be fixed include large-size and small-size ones. In this kind of fixing unit, a temperature rise of a portion where the recording paper does not consume heat becomes significant when small-size recording papers of an identical width are continuously fixed, and this has sometimes caused a problem that a rise in the iron core temperature of the excitation coil is caused, resulting in making the heat generation in a portion through which the recording paper passes become unstable and incurring the deterioration of the excitation coil.

Accordingly, as shown in FIG. 9, U.S. Pat. No. 7,005,619 describes an invention that includes a demagnetizing coil 32 placed overlapping an excitation coil 31 through which the recording paper does not pass when a recording paper of a narrow width is fixed by a fixing roller. In the fixing device, a current that cancels a change in the magnetic flux caused by the excitation coil 31 flows through the demagnetizing coil 32 when the loop of the demagnetizing coil 32 is closed, by which the alternating magnetic field at an end where the recording paper does not pass is diminished, allowing the heat value of the fixing roller to be partially reduced.

FIG. 10 shows the distribution of the heat value in the axial direction of the fixing roller of FIG. 9. It can be understood that, although a virtually uniform generation of heat is observed since there is no demagnetizing effect in a state in which the demagnetizing coil is open as shown in the figure, the generation of heat in the portion where the demagnetizing coil is located largely drops when the demagnetizing coil is closed.

However, it is difficult to make the region through which the small-size recording paper passes coincide with an end of the demagnetizing coil in the conventional induction heating type fixing device. For example, if a distance between the end of the region through which the small-size recording paper passes and the end of the demagnetizing coil is excessively apart, there is a defect of the occurrence of the deterioration of the fixing roller due to the excessive temperature rise thereof as a consequence of a high generation of heat of the fixing roller and a temperature rise in the region through which the small-size recording paper passes. Conversely, if the distance between the end of the region through which the small-size recording paper passes and the end of the demagnetizing coil is excessively overlapped, there is a defect of the occurrence of defective fixing, irregular luster and offset as a consequence of a low generation of heat of the fixing roller and a fall in the temperature of the region through which the small-size recording paper passes. That is, a trouble due to overheating or the defective fixing due to a shortage in the generation of heat is to occur unless the transitional portion of the heat value coincides with the end of the recording paper.

If the fixing device is designed so that the end of the demagnetizing coil coincides with the region through which the end of the paper passes in order to avoid the inconvenience described above, a shift in the position of the paper to be conveyed tends to occur every apparatus, and the trouble described above has still occurred. Furthermore, it is possible to provide demagnetizing coils dividedly in multiplicity for the recording papers of which the paper widths largely differ as in the case of, for example, A4-size paper and A3-size paper. However, the demagnetizing coil cannot be divided for the recording papers of which the paper widths slightly differ as in the case of, for example, A4-size paper and B5-size paper or letter-size paper, meaning that proper management has not been achieved in actuality.

SUMMARY OF THE INVENTION

In view of the problems described above, an object of the present invention is to provide a fixing device capable of reducing the trouble due to overheating and the defective fixing due to a shortage in the generation of heat even when a plurality of kinds of recording papers of slightly different sizes are used.

In order to solve the problem, the present invention provides a fixing device having a fixing rotor that is driven to rotate and fixes a toner image by heating a recording paper while conveying the paper pressurized against the rotor, an excitation coil that is provided extending in the axial direction along the fixing rotor and causes induction heating by applying an alternating magnetic field to the fixing rotor, and a demagnetizing coil that is provided superposed on an end of the excitation coil and is able to partially diminish the magnetic flux generated by the excitation coil, in which the shape of the portion that belongs to the demagnetizing coil and overlaps the excitation coil does not have an axis of symmetry in the direction in which the recording paper is conveyed.

According to the construction, the shape of the portion that belongs to the demagnetizing coil and is superposed on the end side of the excitation coil and the shape of the portion that belongs to the demagnetizing coil and overlaps the center side of the excitation coil are made asymmetrical, by which the number of magnetic fluxes that the demagnetizing coil diminish can be made different between the end side and the center side of the excitation coil. If the number of magnetic fluxes diminished by the demagnetizing coil on the center side is decreased, the heat value of the fixing rotor can be gently changed depending on the positions. Therefore, the range in the width of applicable recording paper between the width of the recording paper in which the defective fixing is caused by the shortage in the generation of heat due to the effect of the demagnetizing coil and the width of the recording paper in which the demagnetizing coil takes an insufficient effect and part of the fixing rotor abnormally overheats can be widened.

Moreover, if the demagnetizing coil has the number of magnetic fluxes for diminishment monotonously decreasing from the end of the excitation coil toward the center of the excitation coil in the fixing device of the present invention, the heat value of the fixing rotor can be monotonously increased gently from the end of the excitation coil toward the center of the excitation coil, and the range in the width of the applicable recording paper can be widened.

Moreover, if the width of the demagnetizing coil monotonously reduced from the end of the excitation coil toward the center of the excitation coil in the fixing device of the present invention, the effect of diminishing the magnetic fluxes can be gradually reduced, and the range in the width of the applicable recording paper can be widened.

Moreover, if the demagnetizing coil is made asymmetrical back and forth in the direction of rotation of the fixing rotor in the fixing device of the present invention, it is easy to make a change in the effect of the demagnetizing coil, and the range in the width of the applicable recording paper can be widened.

Moreover, if the demagnetizing coil is wound in a wedge-like shape in the fixing device of the present invention, the heat value of the fixing rotor can be monotonously increased linearly from the end of the excitation coil toward the center of the excitation coil, by which the range in the width of the applicable recording paper can be widened, and it is easy to estimate the range in the designing stage.

Moreover, if the demagnetizing coil is arranged inclined with respect to the excitation coil in the fixing device of the present invention, the portion that belongs to the demagnetizing coil and protrudes from the excitation coil takes no effect, and only the portion of the demagnetizing coil overlapping the excitation coil becomes an effective portion that diminishes the magnetic fluxes. Therefore, the heat value of the fixing rotor can be gently changed.

Moreover, if demagnetizing coils are provided at both ends of the fixing rotor in the fixing device of the present invention, the heat value of the fixing rotor can be made appropriate in the image forming apparatus in which the recording paper is made to pass while being aligned centered in the widthwise direction. If the demagnetizing coils at both ends have an identical shape, no cost increase results since a common die can be used. Furthermore, if the demagnetizing coils are arranged point-symmetrically with respect to the center of the excitation coil, the construction contributes to the downsizing of the apparatus since the retention structures of the demagnetizing coils at both ends are hard to interfere with each other.

Moreover, if the demagnetizing coil is provided rotationally movable or parallel displaceable with respect to the excitation coil in the fixing device of the present invention, the range in the width of the applicable recording paper can be further expanded by increasing and decreasing the effective portion of the demagnetizing coil overlapping the excitation coil.

Moreover, another aspect of the fixing device of the present invention is an induction heating type fixing device that fixes a toner image on the recording paper while conveying the recording paper. The fixing device includes a fixing rotor formed of a conductive material, a pressurizing member that is provided in contact with the fixing rotor and temporarily holds the conveyed recording paper between the member and the fixing rotor, an excitation coil that is formed by winding a conductive wire a plurality of turns forming a layer and is provided along the fixing rotor in order to inductively heat the fixing rotor, and a demagnetizing coil that is placed along the excitation coil in the proximity of an end of the fixing rotor and induces a counter electromotive force in a direction in which the magnetic flux thereof is cancelled by the magnetic flux generated by the excitation coil, the excitation coil having a parallel portion parallel to the axis of the fixing rotor, the demagnetizing coil having an inclined portion obliquely extending with respect to the axis of the fixing rotor, and the inclined portion of the demagnetizing coil being arranged in a relation that the inclined portion is gradually apart from the parallel portion of the excitation coil as getting closer to the center of the fixing roller.

Moreover, in the fixing device of the present aspect, the inclined portion of the demagnetizing coil may be linear.

Moreover, the fixing device of the present aspect may have a structure in which the excitation coil is constructed of two parallel portions parallel to the axis of the fixing rotor, two side portions extending in a direction perpendicular to the parallel portions of the excitation coil, and four bent portions that connect the parallel portions with the side portions, the demagnetizing coil is constructed of one parallel portion parallel to the axis of the fixing rotor, one side portion extending from one end of the parallel portion of the demagnetizing coil in the direction perpendicular to the parallel portion of the demagnetizing coil, an inclined portion extending from the other end of the parallel portion of the demagnetizing coil toward the tip end of the side portion of the demagnetizing coil, and three bent portions that connect the parallel portion, the side portion and the inclined portion together, the parallel portion of the demagnetizing coil is superposed on the parallel portion of the demagnetizing coil, the side portion of the demagnetizing coil is superposed on the side portion of the excitation coil, and the inclined portion of the demagnetizing coil is placed in an upper space located between the two parallel portions of the excitation coil.

Moreover, in the fixing device of the present aspect, the demagnetizing coils may be arranged in the proximities of both ends of the fixing rotor.

Moreover, in the fixing device of the present embodiment, the two demagnetizing coils may be arranged point-symmetrically with respect to the center of the fixing rotor.

As described above, according to the present invention, by making the portion that belongs to the demagnetizing coil and overlaps the excitation coil have an asymmetric shape that includes no axis of symmetry in the direction in which the recording paper is conveyed, the heat value of the fixing rotor is gently changed in the axial direction, and the range in the width of the applicable recording paper can be widened.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE PREFERRED EMBODIMENTS

Figure 1:
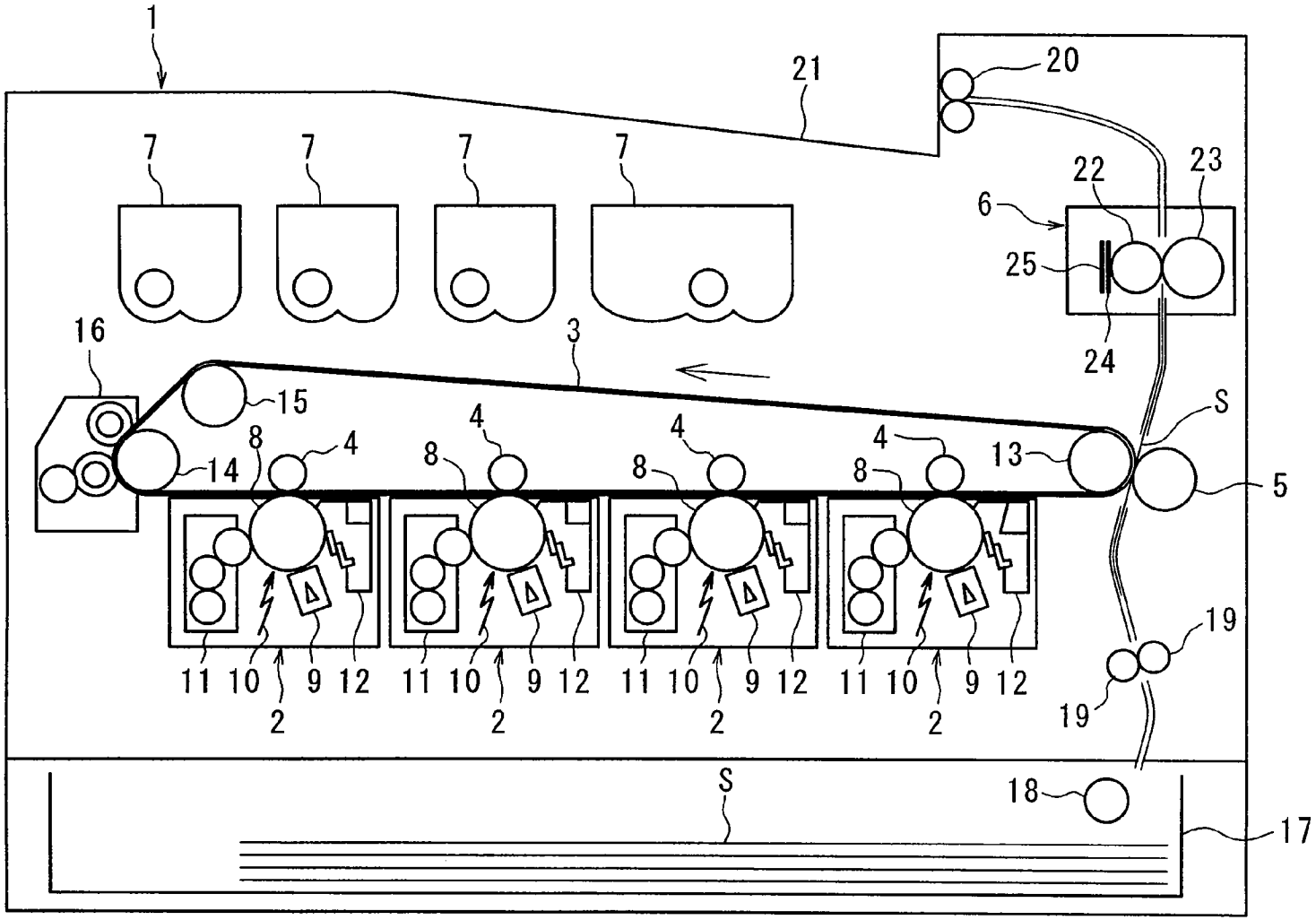
FIG. 1 is a schematic view of the image forming apparatus of the first embodiment of the present invention.

FIG. 1 shows an image forming apparatus 1 of the first embodiment of the present invention. The image forming apparatus 1 has four developing units 2 that form images with yellow, magenta, cyan and black toners, a transfer belt 3, a primary transfer roller 4 that transfers each of the toner images formed by the developing units 2 onto the transfer belt 3 by an electrostatic force, a secondary transfer roller 5 that transfers the toner image that has been transferred to the transfer belt 3 onto a recording paper S by an electrostatic force, a fixing unit 6 that fixes the toner image by heating the recording paper S, and four toner cartridges 7 that supply yellow, magenta, cyan and black toners to the developing units 2.

Each of the developing units 2 has a rotational drum-shaped photoreceptor 8, an electric charger 9 that electrically charges the photoreceptor 8, an exposure unit 10 that forms an electrostatic latent image by exposing the charged photoreceptor 8 to light, a developing unit 11 that forms a toner image by making a toner T adhere to the electrostatic latent image, and a cleaner 12 that scrapes the toner off the surface of the photoreceptor 8.

The transfer belt 3 is wound around a driving roller 13 driven by a motor (not shown), a driven roller 14 and a tension roller 15 that gives a tension and is rotated in the direction of arrow by the driving roller 13. Moreover, the image forming apparatus 1 has a cleaner unit 16 that removes the toner remaining on the surface of the transfer belt 3.

The recording papers S are supplied to a paper feeding section 17 and fed one by one by a feeding roller 18, conveyed to the secondary transfer roller 5 by a conveyance roller 19 and discharged through the fixing unit 6 to a paper discharge section 21 by a paper discharge roller 20.

The fixing device 6 has a fixing roller (fixing rotor) 22 that is driven to rotate and made of a conductive material, a pressure roller (pressure contact member) 23 that is pressurized against the fixing roller 22 and forms a nip to hold the recording paper S, an excitation coil 24 that causes induction heating by applying an alternating magnetic field to the fixing roller 22, and a demagnetizing coil 25 that is provided partially overlapping the excitation coil 24.

Figure 2:
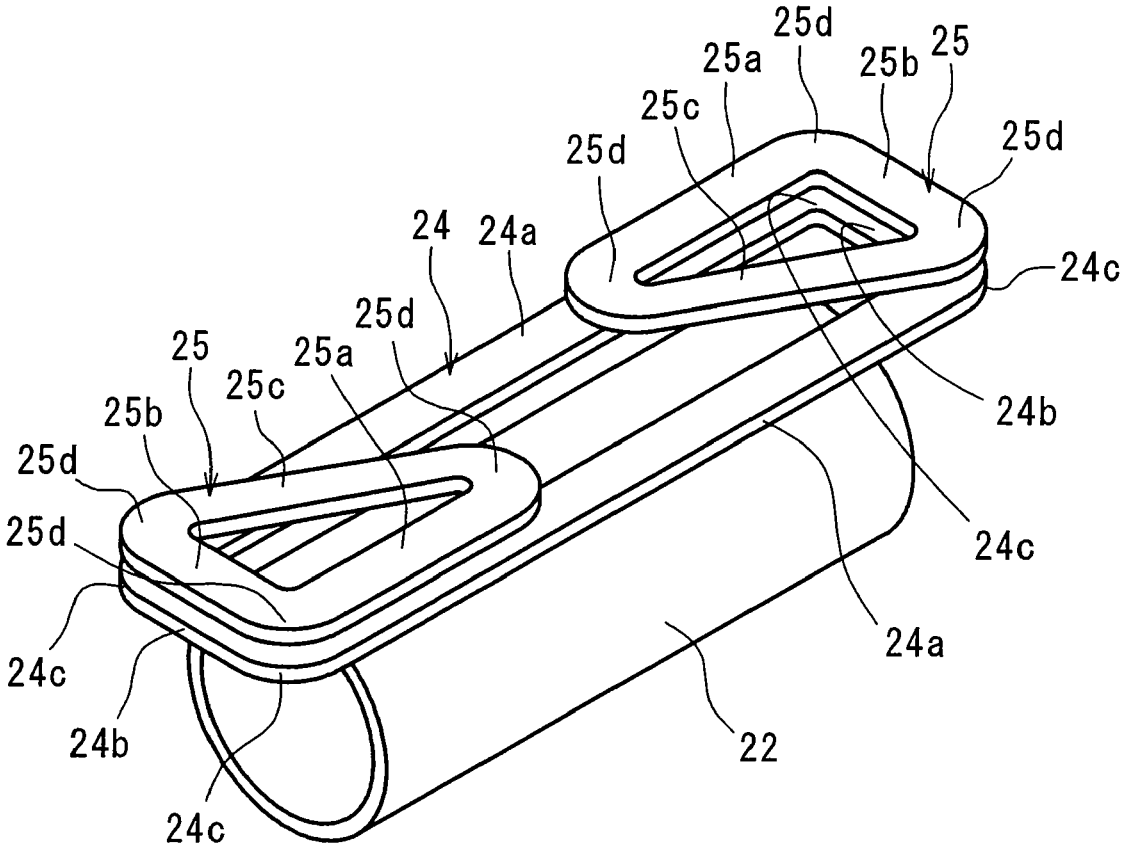
FIG. 2 is a schematic partial perspective view of the fixing device of FIG. 1.

FIG. 2 schematically shows the fixing roller 22, the excitation coil 24 and the demagnetizing coil 25 of the fixing device 6. The fixing roller 22 is formed of a metal pipe whose surface is coated with a resin and driven to rotate by a drive motor (not shown).

The excitation coil 24 is formed of a conductive wire wound a plurality of turns in a virtually rectangular parallelepiped shape forming a layer and is constructed of two parallel portions 24*a* parallel to the axis of the fixing roller 22, side portions 24*b* extending in a direction perpendicular to the parallel portions 24*a*, and four bent portions 24*c* that connect the parallel portions 24*a* and the side portions 24*b* together. The coil is provided extending along the fixing roller 22 in the axial direction of the fixing roller 22. Moreover, the excitation coil 24 is connected to a high-frequency power circuit (not shown) and generates an alternating magnetic field by a applying high-frequency current, the alternating magnetic field being applied to the fixing roller 22. In the fixing roller 22 to which the alternating magnetic field is applied, an eddy current internally flows in a direction in which the magnetic flux change is canceled, and heat is generated by the occurrence of Joule loss. That is, the excitation coil 24 is able to cause induction heating in the fixing roller 22.

The demagnetizing coils 25 are provided overlapping both ends of the excitation coil 24 and formed into a wedge-like shape of a right-angled triangle of which two sides are virtually superposed on the excitation coil 24. In concrete, the demagnetizing coil 25 has one parallel portion 25*a* parallel to the axis of the fixing roller 22, one side portion 25*b* extending in a direction perpendicular to the parallel portion 25*a* from one end of the parallel portion 25*a*, an inclined portion 25*c* extending from the other end of the parallel portion 25*a* toward the tip end of the side portion 25*b*, and three bent portions 25*d* that connect the parallel portion 25*a*, the side portion 25*b* and the inclined portion 25*c* together.

The two demagnetizing coils 25 provided at both ends of the excitation coil 24 have an identical shape and are arranged point-symmetrically (rotationally symmetrical at an angle of 180°) with respect to the center of the excitation coil 24. In detail, the parallel portion 25*a* of each demagnetizing coil 25 is superposed on the parallel portion 24*a* of the excitation coil 24, the side portion 25*b* of the demagnetizing coil 25 is superposed on the side portion 24*b* of the excitation coil 24, and the inclined portion 25*c* of the demagnetizing coil 25 is arranged in an upper space located between the two parallel portions 24*a* of the excitation coil 24. That is, the inclined portion 25*c* of the demagnetizing coil 25 is arranged obliquely with respect to the axis of the fixing roller 22 in a relation that the inclined portion is gradually apart from the parallel portion 24*a* of the excitation coil 24 (getting closer to the parallel portion 24*a* on the opposite side) as getting closer to the center of the fixing roller 22. The demagnetizing coils 25 can each open and close the loop thereof by means of a switch (not shown).

If the demagnetizing coil 25 is closed, an induction current flows through the demagnetizing coil 25 so as to cancel the change in the magnetic flux that penetrates the demagnetizing coil 25 when the excitation coil 24 generates an alternating magnetic field. As a result, the demagnetizing coil 25 reduces the alternating magnetic field applied to both ends of the fixing roller 22 and suppresses the generation of heat at both ends of the fixing roller 22.

Figure 3:
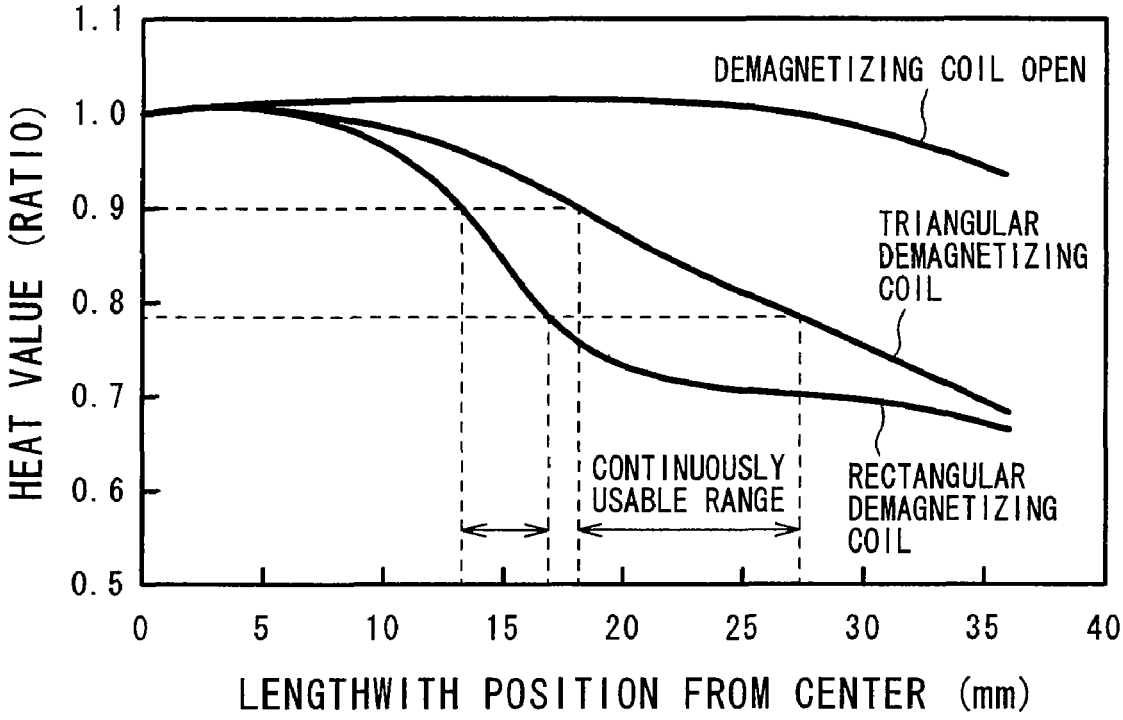
FIG. 3 is a graph showing the distribution of the heat value of the fixing roller of FIG. 2.

FIG. 3 shows the distribution of the heat value in the axial direction of the fixing coil 22. In the figure, the horizontal axis represents a distance in a direction directed from the center of the fixing roller 22 toward the end of the fixing roller 22 in the lengthwise direction, and the vertical axis represents the ratio of the heat value in each position when the heat value in the center is assumed to be one. The figure shows the distribution of the heat value in the case where the demagnetizing coil of the conventional type wound in a rectangular parallelepiped shape whose short side and long side have the same lengths as those of the demagnetizing coil 25 in addition to the case where the demagnetizing coil 25 is closed and the case where the demagnetizing coil 25 is opened to be nullified.

The demagnetizing coil 25 is wound asymmetrically dependently on the end side and the center side of the excitation coil 24 unlike the conventional demagnetizing coil. Therefore, the number of magnetic fluxes of the alternating magnetic field diminished by the demagnetizing coil 25 can be varied dependently on the end side and the center side of the excitation coil 24, and the degree of reduction in the heat value can be reduced on the center side. The above is because the inclined portion 25*c* of the demagnetizing coil 25 is arranged so as to be gradually apart from the parallel portion 24*a* of the excitation coil 24 located just below it as getting closer to the center of fixing coil 25, and therefore, the effect of canceling the magnetic flux of the excitation coil 24 by the demagnetizing coil 25 is also gradually reduced as getting closer to the center side.

In particular, the number of magnetic fluxes of the demagnetizing coil 25 for diminishment becomes decreased as the width in the direction of rotation of the fixing roller 22 becomes narrower depending on the position in the axial direction. Therefore, if the width is monotonously reduced as in the present embodiment, the number of magnetic fluxes for diminishment is monotonously decreased.

When the demagnetizing coil 25 is closed as shown in FIG. 3, the heat value of the fixing roller 22 is gradually reduced toward its end. Since the demagnetizing coil 25 of the present embodiment is formed in a triangular shape, the effect of diminishing the magnetic fluxes of the excitation coil 24 is linearly changed, and the heat value of the fixing roller 22 is reduced linearly and gently toward its end.

With this arrangement, in FIG. 3, assuming that the heat value (ratio) causing an overheating state in the absence of the recording paper is 0.9 and the heat value (ratio) causing defective fixing in the presence of the recording paper is 0.8, then a distance (continuously usable range) between a position where a trouble occurs as a consequence of the overheating state unless heat is consumed by the recording paper S and a position where the toner cannot be fixed due to a shortage in the quantity of heat becomes longer in the present embodiment than in the conventional case when fixing is continuously carried out. That is, the fixing unit 6 has a wide tolerance range in the width of the recording papers S that can be continuously fixed when the demagnetizing coil 25 is closed.

The continuous usable range changes depending on the thermal capacity of the recording paper S, the environmental temperature and so on. Therefore, it is noted that the range shown in the figure is a mere illustration. Moreover, if the number of the recording papers S to be fixed is small, there is no obstacle in fixing the recording papers S of a width outside the range.

Moreover, since the demagnetizing coils 25 of the present embodiment are the coils of an identical shape wound in a right-angled triangle shape that is asymmetrical back and forth in a direction of rotation of the fixing roller 22, the coils can be formed by a common die. Moreover, by virtue of the mutually reversed arrangement, the structures for supporting the two demagnetizing coils 25 do not interfere with each other, and the demagnetizing coils 25 can easily be fixed without enlarging the fixing structure. Furthermore, by virtue of the mutually reversed arrangement of the two demagnetizing coils 25, it becomes possible to arrange the two demagnetizing coils 25 so that the coils partially overlap in the axial direction of the fixing roller 22 and adjust the delicate heat value distribution in the axial direction.

Figure 4:
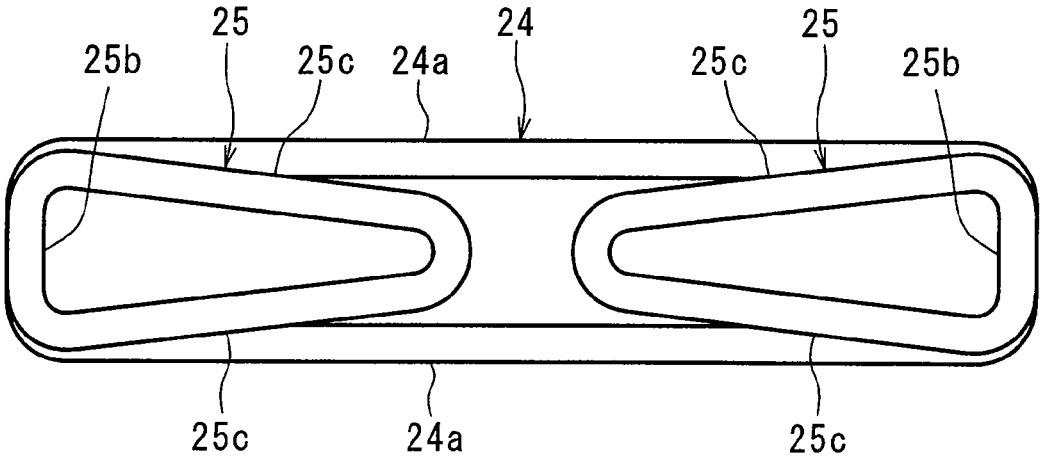
FIG. 4 is a side view showing the demagnetizing coil of the second embodiment of the present invention.

With regard to the shape of the demagnetizing coil 25, the coil may be wound in a wedge-like shape of an isosceles triangle such that only the side portion 25*b* is superposed on the excitation coil 24 and the remaining two sides serve as inclined portions 25*c* that are oblique with respect to the parallel portions 24*a* of the excitation coil 24 like the demagnetizing coil 25 of the second embodiment of the present invention shown in FIG. 4. Also, in the present embodiment, the effect of diminishing the magnetic fluxes that the excitation coil 24 forms by the demagnetizing coil 25 linearly changes in the axial direction, and a heat generation characteristic of the fixing roller 22 virtually equivalent to the one of FIG. 3 can be obtained.

If the inclined portions 25*c* of the demagnetizing coils 25 are constituted of curves, the gradient of the heat value can freely be set.

Figure 5:
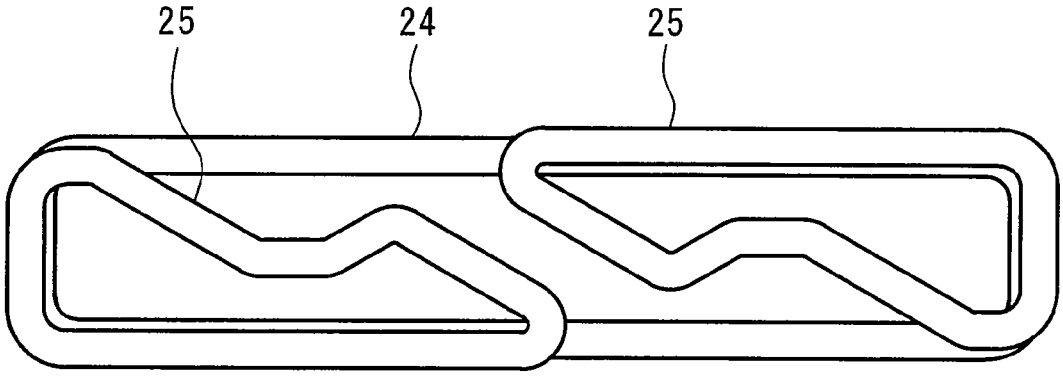
FIG. 5 is a side view showing the demagnetizing coil of the third embodiment of the present invention.

Moreover, with regard to the shape of the demagnetizing coil 25, the coil may have a shape quite different from a triangle, and it is acceptable to provide a point of inflection for the change in the width so as to provide a local maximum point and a local minimum point of the heat value according to the desired distribution of the heat value of the fixing roller 22 like the demagnetizing coils 25 of the third embodiment of the present invention shown in FIG. 5. In other words, the change in the width of the demagnetizing coil 25 is not necessarily be monotonously reduced toward the center of the excitation coil 24, and the change in the width of the demagnetizing coil 25 may be reduced in stages by providing partway a portion parallel to the excitation coil 24.

Furthermore, it is also possible that the demagnetizing coil 25 of the present invention is constituted of only free-form curves.

Figure 6:
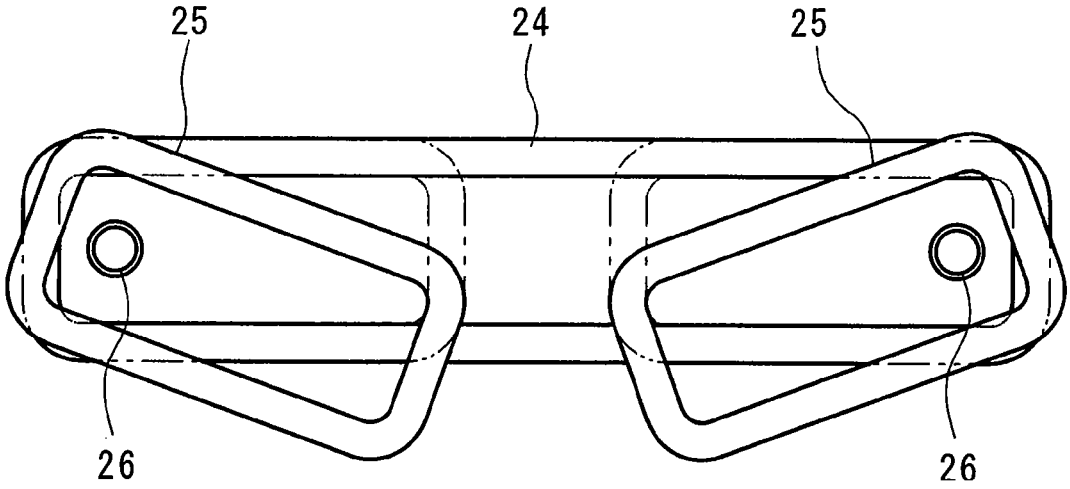
FIG. 6 is a side view showing the demagnetizing coil of the fourth embodiment of the present invention.

Moreover, as the demagnetizing coil 25 of the fourth embodiment shown in FIG. 6, according to the present invention, by arranging a rectangular demagnetizing coil 25 inclinedly with respect to the excitation coil 24 so that the coil largely overlaps the excitation coil 24 on the end side and do not largely overlap the excitation coil 24 on the center side, a portion that belongs to the demagnetizing coil 25 and overlaps the excitation coil 24, i.e., the effective region of the demagnetizing coil 25 may be gradually reduced from the end toward the center of the demagnetizing coil 25.

Also, with this arrangement, the diminishing rate of the magnetic fluxes of the excitation coil 24 by the demagnetizing coil 25 can be gently changed, and the heat value of the fixing roller 22 is gently changed in the axial direction, allowing the recording papers S of a variety of widths to be stably fixed.

Moreover, it is acceptable to make the demagnetizing coil 25 pivotable around a pivot axis 26 provided in the proximity of the end of the excitation coil 24 in the present embodiment, allowing the angle of inclination to the excitation coil 22 to be adjustable. With this arrangement, the range in the width of the paper that can be continuously fixed can be changed, and this makes it possible to carry out optimal operation for the recording papers S of a wider variety of sizes.

Figure 7:
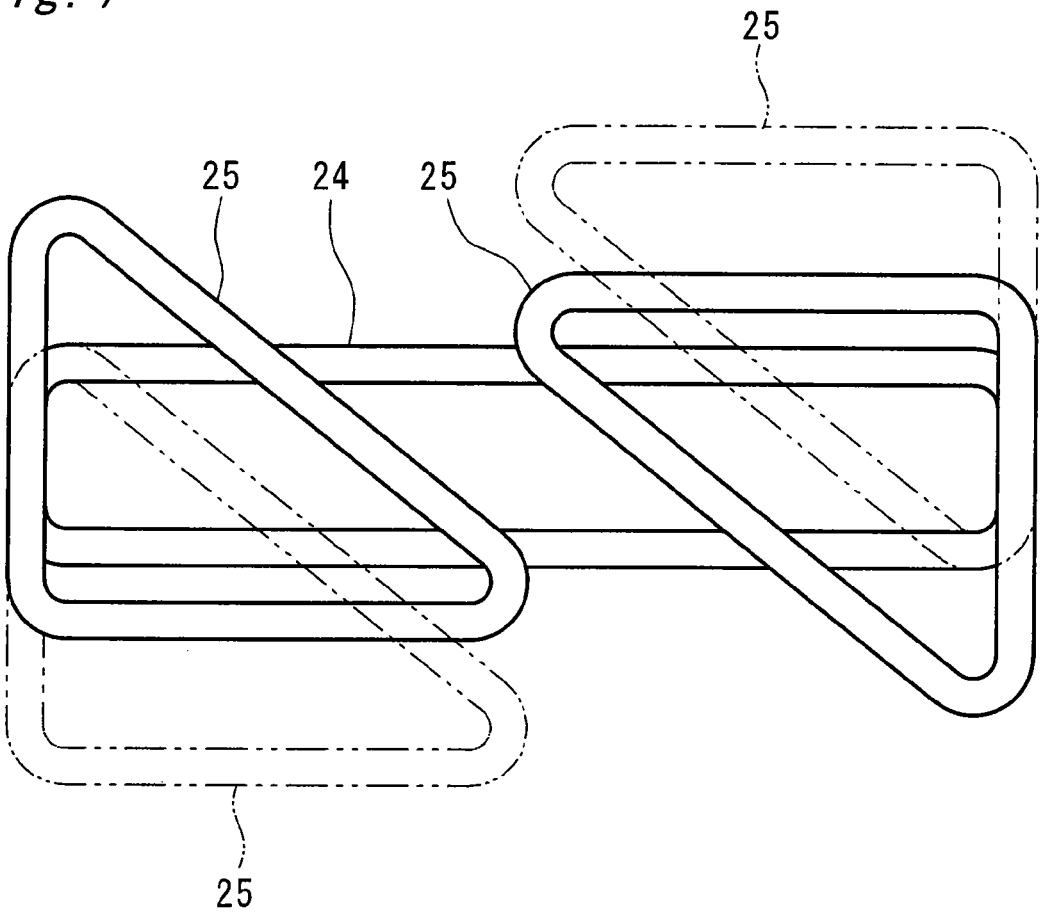
FIG. 7 is a side view showing the demagnetizing coil of the fifth embodiment of the present invention.
Figure 8:
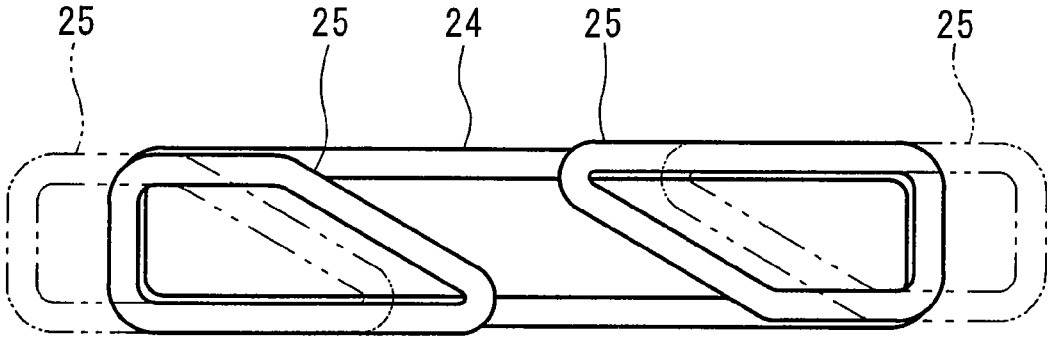
FIG. 8 is a side view showing the demagnetizing coil of the sixth embodiment of the present invention.
Figure 9:
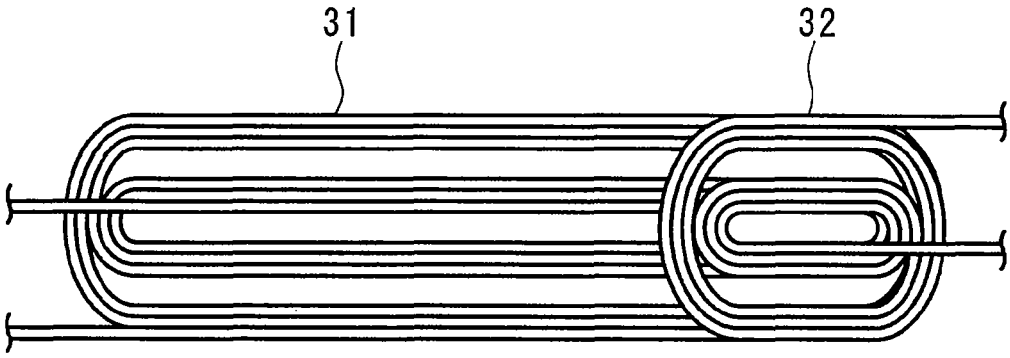
Fig. 9 PRIOR ART
FIG. 9 is a schematic partial perspective view of the conventional fixing device.
Figure 10:
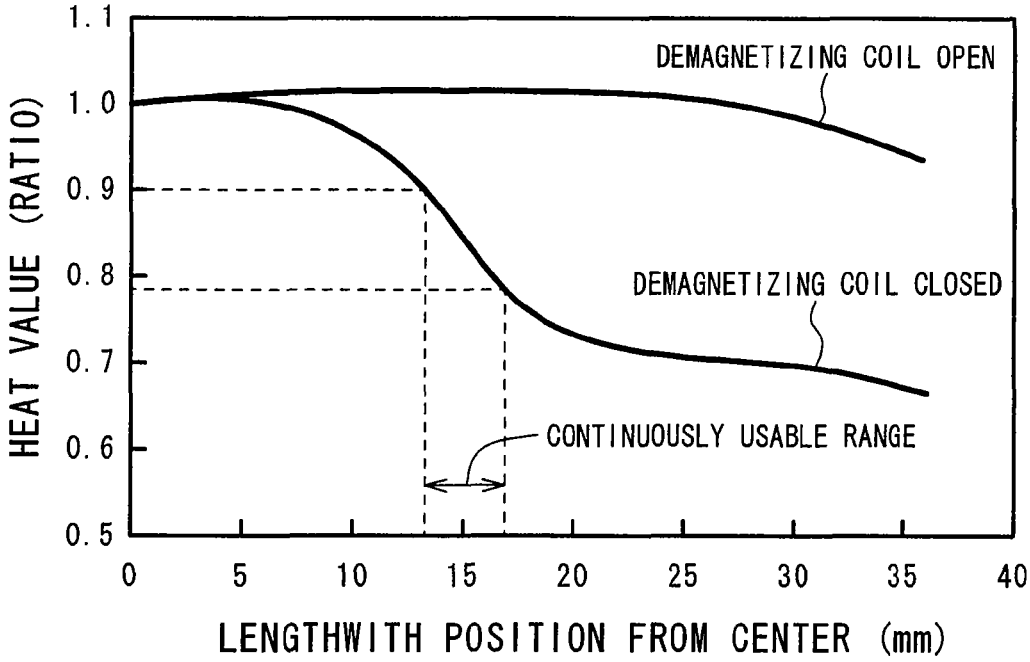
Fig. 10 PRIOR ART
FIG. 10 is a graph showing the distribution of the heat value of the conventional fixing roller.

Moreover, according to the present invention, like the fifth embodiment shown in FIG. 7 and the sixth embodiment shown in FIG. 8, it is acceptable to change the configuration of the overlapping portions of the demagnetizing coil 25 and the excitation coil 24 by making the demagnetizing coil 25 to be parallel displaceable in the axial direction of the fixing roller 22 or in the direction perpendicular to the axis of the fixing roller 22.

In each of the embodiments, the range in which the heat value of the fixing roller 22 is linearly reduced moves parallel in the axial direction by the movement of the demagnetizing coil 25. As a result, the range in the width of the recording paper S that can be continuously fixed can be selected.

When the conventional demagnetizing coil of a narrow width of transition of the heat value is moved in the axial direction, the demagnetizing coil needs to be finely moved in accordance with the size of the applied recording paper S. However, in the present embodiment, by grouping the sizes of recording papers S into several groups and determining the position of the demagnetizing coil 25 for each group, recording papers S of all sizes become able to be continuously fixed. Moreover, only positioning the demagnetizing coil 25 by means of, for example, a simple mechanism that can select between two positions can cope with the recording papers S of a wide variety of paper widths.

As described above, the present invention is characterized in that the tolerance range in the width of the recording paper S that can be continuously fixed is widened by gently changing the effective width of the demagnetizing coil 25 in the axial direction of the fixing roller 22.

Although the demagnetizing coils 25 are arranged overlapping both ends of the excitation coil 24 in the illustrated embodiments, it is proper to provide the demagnetizing coil 25 at only one end of the excitation coil 24 when the recording papers S have their edges aligned laterally to either the right-hand end or the left-hand end in the direction in which the recording papers S pass.

Although the present invention has been described in connection with the preferred embodiments thereof with reference to the accompanying drawings, it is noted that various modifications and corrections are apparent to those skilled in this art. It should be appreciated that such modifications and corrections are included within the scope of the appended claims unless they depart from the scope of the present invention.

What is claimed is:

1. A fixing device comprising:

a fixing rotor that is driven to rotate and fixes a toner image by heating a recording paper while conveying the paper pressurized against the fixing rotor;

an excitation coil that is provided extending in an axial direction along the fixing rotor and causes induction heating by applying an alternating magnetic field to the fixing rotor; and a demagnetizing coil that is provided superposed on an end of the excitation coil and is able to partially diminish a magnetic flux generated by the excitation coil, wherein a shape of a portion that belongs to the demagnetizing coil and overlaps the excitation coil does not have an axis of symmetry in a direction in which the recording paper is conveyed.

2. The fixing device as claimed in claim 1, wherein the demagnetizing coil has a number of magnetic fluxes for diminishment decreasing monotonously from the end of the excitation coil toward the center of the excitation coil.

3. The fixing device as claimed in claim 1, wherein the demagnetizing coil has a width decreasing monotonously from the end of the excitation coil toward the center of the excitation coil.

4. The fixing device as claimed in claim 1, wherein the demagnetizing coil is asymmetrical back and forth in a direction of rotation of the fixing rotor.

5. The fixing device as claimed in claim 4, wherein the demagnetizing coil is wound in a wedge-like shape.

6. The fixing device as claimed in claim 1, wherein the demagnetizing coil is arranged inclined with respect to the excitation coil.

7. The fixing device as claimed in claim 1, wherein the demagnetizing coil is provided at both ends of the fixing rotor, and both demagnetizing coils have an identical shape.

8. The fixing device as claimed in claim 7, wherein the two demagnetizing coils are arranged point-symmetrically with respect to the center of the excitation coil.

9. The fixing device as claimed in claim 1, wherein the demagnetizing coil is provided rotationally movable or parallel displaceable with respect to the excitation coil.

10. An image forming apparatus comprising the fixing device claimed in claim 1.

11. The fixing device as claimed in claim 1, wherein the excitation coil is arranged on an exterior portion of the fixing rotor.

12. An induction heating type fixing device that fixes a toner image on a recording paper while conveying the recording paper, the device comprising:

a fixing rotor formed of a conductive material;

a pressurizing member that is provided in contact with the fixing rotor and temporarily holds the conveyed recording paper between the fixing rotor and the pressurizing member;

an excitation coil that is formed by winding a conductive wire a plurality of turns forming a layer and is provided along the fixing rotor in order to inductively heat the fixing rotor; and a demagnetizing coil that is placed along the excitation coil in the proximity of an end of the fixing rotor and induces a counter electromotive force in a direction in which the magnetic flux thereof is cancelled by a magnetic flux generated by the excitation coil, wherein the excitation coil has a parallel portion parallel to an axis of the fixing rotor, the demagnetizing coil has an inclined portion obliquely extending with respect to the axis of the fixing rotor, and the inclined portion of the demagnetizing coil is arranged in a relation that the inclined portion is gradually apart from the parallel portion of the excitation coil as getting closer to the center of the fixing roller.

13. The fixing device as claimed in claim 12, wherein the inclined portion of the demagnetizing coil is linear.

14. The fixing device as claimed in claim 12, wherein the excitation coil is comprised of two parallel portions parallel to the axis of the fixing rotor, two side portions extending in a direction perpendicular to the parallel portions of the excitation coil, and four bent portions that connect the parallel portions with the side portions, the demagnetizing coil is comprised of one parallel portion parallel to the axis of the fixing rotor, one side portion extending from one end of the parallel portion of the demagnetizing coil in a direction perpendicular to the parallel portion of the demagnetizing coil, an inclined portion extending from the other end of the parallel portion of the demagnetizing coil toward a tip end of the side portion of the demagnetizing coil, and three bent portions that connect the parallel portion, the side portion and the inclined portion together, the parallel portion of the demagnetizing coil is superposed on the parallel portion of the demagnetizing coil, the side portion of the demagnetizing coil is superposed on the side portion of the excitation coil, and the inclined portion of the demagnetizing coil is placed in an upper space located between the two parallel portions of the excitation coil.

15. The fixing device as claimed in claim 12, wherein the demagnetizing coils are placed in the proximities of both ends of the fixing rotor.

16. The fixing device as claimed in claim 15, wherein the two demagnetizing coils are arranged point-symmetrically with respect to the center of the fixing rotor.

* * * * *